US006741238B2

(12) United States Patent
Choi

(10) Patent No.: US 6,741,238 B2
(45) Date of Patent: May 25, 2004

(54) POWER SAVING CIRCUIT FOR DISPLAY PANEL

(75) Inventor: Jeung Hie Choi, Cheongju (KR)

(73) Assignee: Hyundai Electronics Industries Co., Ltd., Ichon-shi (KR)

( * ) Notice: Subject to any disclaimer, the term of this patent is extended or adjusted under 35 U.S.C. 154(b) by 0 days.

(21) Appl. No.: 09/777,675

(22) Filed: Feb. 7, 2001

(65) Prior Publication Data

US 2001/0012005 A1 Aug. 9, 2001

(30) Foreign Application Priority Data

Feb. 8, 2000 (KR) ..... 2000-5758

(51) Int. Cl.[7] ..... G09G 5/00

(52) U.S. Cl. ..... 345/211; 345/51; 345/53; 345/68; 345/94; 345/208; 345/210; 345/214; 345/215

(58) Field of Search ..... 345/51, 53, 68, 345/80, 87, 90, 94–100, 104, 208, 211, 214; 257/351; 327/111–112, 434, 437, 537; 349/38, 48, 41, 42; 323/223

(56) References Cited

U.S. PATENT DOCUMENTS 5,528,256 A 6/1996 Erhart et al. ..... 345/96
5,717,437 A * 2/1998 Sano et al. ..... 345/204
5,828,353 A * 10/1998 Kishi et al. ..... 345/55
5,943,030 A * 8/1999 Minamibayashi ..... 345/60
6,046,614 A * 4/2000 Takahashi ..... 327/111
6,057,815 A * 5/2000 Sano ..... 345/60
6,072,447 A * 6/2000 Noborio ..... 345/60
6,184,875 B1 * 2/2001 Matsuura ..... 292/355
6,249,279 B1 * 6/2001 Shirasawa ..... 315/169.1
6,271,816 B1 * 8/2001 Jeong et al. ..... 345/87
6,288,714 B2 * 9/2001 Yamamoto et al. ..... 345/208
6,359,608 B1 * 3/2002 Lebrun et al. ..... 345/100
6,366,063 B1 * 4/2002 Sekii ..... 323/223
6,448,947 B1 * 9/2002 Nagai ..... 345/60
6,452,590 B1 * 9/2002 Awamoto et al. ..... 345/211

* cited by examiner

*Primary Examiner*—Vijay Shankar
*Assistant Examiner*—Leonid Shapiro
(74) *Attorney, Agent, or Firm*—Fleshner & Kim, LLP

(57) ABSTRACT

A power saving circuit for a liquid crystal panel (LCD) and a plasma display panel (PDP) recovers an energy charged in a panel capacitor through one path of a drive IC driving a scan electrode or data electrode for the PDP, and recovers the energy charged in the panel capacitor through one path of a column drive IC or row drive IC for the LCD panel. The energy recovery path can be a parasitic diode or protective diode of the drive IC. The power saving circuit can operate in an addressing period.

11 Claims, 9 Drawing Sheets

VDD
VDD/2

①

⑪

⑫

⑮

POWER SAVING CIRCUIT FOR DISPLAY PANEL

BACKGROUND OF THE INVENTION

1. Field of the Invention

The present invention relates to a driving circuit for a display panel, and in particular, to a power saving circuit for a liquid crystal display (LCD) panel and a plasma display panel (PDP).

2. Background of the Related Art

FIG. 1 is a cross-sectional view illustrating a pixel structure of a plasma display panel (PDP) according to the related art. As shown in FIG. 1, one pixel includes an upper plate 6 and a lower plate 7 that are aligned to face each other separated by a discharge space 8. In FIG. 1, the upper plate 6 forms a display screen panel, and the discharge space 8 is sealed up with a discharge excitation gas such as Ne—Xe mixture gas or He—Xe mixture gas. A scan electrode 1 and a sustain electrode 2 are positioned on the upper plate, facing each other, and a data electrode 3 (or address electrode) aligned orthogonal to the scan electrode 1 and the sustain electrode 2 is formed on the lower plate 7. A dielectric body (not shown) is spread on the data electrode 3. In addition, a barrier rib 4 for dividing each pixel is arranged on the data electrode, and a phosphor layer 5 is spread on the dielectric body covering the barrier rib 4 and the address electrode 3.

Accordingly, three grooves corresponding to red (R), green (G) and blue (B) and spread along the barrier rib 4 compose one pixel. The plasma gas reacts with the phosphor layer 5, and thus, the pixel generates lights of red, green and blue.

FIG. 3 illustrates a related art PDP driving circuit. As shown in FIG. 3, the related art PDP driving circuit includes a PDP 9, a scan drive IC 10, a data drive IC 11, a scan common pulse generator 12, a sustain pulse generator 13, a scan common energy recovering unit 14 and a sustain energy recovering unit 15.

Each pixel of the PDP 9 is operated and controlled by a voltage inputted to the scan electrode 1, the sustain electrode 2 and the data electrode 3. The pixels positioned on a line 1–480 selected by the scan electrode 1 receive an effective data through the data electrode 3. The data inputted through the data electrode 3 causes discharge to the scan electrode 1 and the sustain electrode 2. Selection of one line implies that the voltage is applied to the scan electrode 1. Such an operation is performed by the scan drive IC 10, the scan common pulse generator 12 and a common voltage generator (not shown).

The scan common pulse generator 12 outputs a common pulse signal of VH level (VH>VDD) according to control signals ③, ④ and the scan drive IC 10 outputs a pulse signal of VDD level according to a control signal ②. Accordingly, an added value of the common pulse signal and the pulse signal, namely a scan pulse signal is inputted to the scan electrode 1, thereby selecting one scan electrode line.

When one scan electrode line is selected, the data drive IC 11 outputs the effective data (video data) to the pixels existing on the corresponding display line. That is, the data drive IC 11 applies the data pulse of VDD level to the address electrode 3 according to a pixel data ① provided by a memory (not shown), thereby writing the pixel data on the pixels of the selected line.

The above operation is sequentially performed during an address period of FIG. 4. When the write operation of the pixel data is finished in regard to the pixels on all of the scan lines 1–480, the respective pixels emit a light during a sustain period as shown in FIG. 4. In the sustain period, the scan common pulse generator 12 outputs a first discharge sustain pulse signal of VH level according to the control signals ③, ④, and the sustain pulse generator 13 outputs a second discharge sustain pulse signal of VH level according to control signals ⑤, ⑥, at a timing different relative to a timing of the first discharge sustain pulse signal.

Accordingly, during the sustain period, the first and second discharge sustain pulse signals are alternately applied to the scan electrode 1 and the sustain electrode 2. Thus, the PDP generates a light recognizable by human beings. Numbers of the first and second discharge sustain pulse signals applied to the scan electrode 1 and the sustain electrode 2 are discriminated for a gradation display as described below.

As described above, when the operation for one sub-frame is finished by sequentially carrying out the address period and the sustain period, the recorded data of the pixels must be all deleted for a next sub-frame. This period is a reset period as shown in FIG. 4.

Thus, in the PDP, the gradation is embodied in a digital method, which differs from a general cathode ray tube (CRT). That is, the CRT controls a degree of luminance by varying a strength of an electron beam injected to the respective pixels in an analog method, while the PDP controls the degree of luminance of the phosphor layer 5 by discriminating the numbers of the first and second discharge sustain pulse signals.

As shown in FIG. 2, to embody 256 gradation for a display, one field (16.7 ms), which is a time for outputting one frame on a display screen according to the NTSC standard, is divided into 8 sub-frames SF1~SF8. The above-described operation of the reset period, scan period and sustain period is performed on each sub-frame. As shown in FIG. 2, the sustain period is increased in the respective frames at a ratio of $2^n$(n=0, 7). In addition, a luminance number of each sub-frame is discriminated into 8 bits. For instance, in order to set the luminance of a specific pixel to be 112 level, the addressing is performed on the 4th, 5th and 6th sub-frames ($2^4+2^5+2^6=112$). So as to maximize the luminance, the addressing is carried out on the whole frame.

Accordingly, to drive the related art PDP, the scan pulse signal is first applied to the scan electrode 1, and the data pulse signal is applied to the data electrode 3 with an identical timing to perform the record discharge. Then, the discharge sustain pulse signal is alternately applied to the scan electrode 1 and the sustain electrode 2 to perform the sustain discharge to sustain the luminance.

As shown in FIGS. 3–4, the sustain discharge is performed by charging or discharging a capacitance unit (not shown) between the panel electrodes. It is conventionally known that most of the pixel luminance results from the sustain discharge. As a result, the consumption power of the PDP is considerably dependent upon the consumption power of the sustain period. When a large-sized panel is driven, the consumption power of the entire PDP is increased because of the increase of the capacitance and the driving power between the panel electrodes. Therefore, various methods have been suggested for reducing power consumption during the sustain discharge, such as recovering an ineffective power lost by the discharge during the sustain period and recycling it during the charge.

As shown in FIG. 3, the related art operation for recovering and recycling the power consumed during the sustain period is performed by the scan common energy recovering unit 14 and the sustain energy recovering unit 15. The scan common energy recovering unit 14 is connected to an output node of the scan common pulse generator 12, and the sustain energy recovering unit 15 is connected to an output node of the sustain pulse generator 13. The constitution and operation of the scan common energy recovering unit 14 and the sustain energy recovering unit 15 are identical. The operation of the scan common energy recovering unit 14 will now be described.

FIGS. 5A and 5B respectively illustrate paths of the scan common energy recovering unit 14 for recovering and recycling the scan common pulse $P_{SC}$ outputted from the scan common pulse generator 12 during the sustain period. FIG. 6 illustrates waveforms of control signals for controlling the energy recovering and recycling operations of the scan common pulse generator 12.

As illustrated in FIG. 6, a control signal ⑦ is enabled just before the scan common pulse $P_{SC}$ outputted from the scan pulse generator 12 transitions from a high level to a low level, in order to turn on a MOS device M1. Accordingly, the scan common pulse $P_{SC}$ is stored in a storage capacitor Cs through a coil, a diode D1 and the MOS device M1. Thus, the scan common energy recovering unit 14 recovers the energy consumed during the sustain period.

To recycle the energy stored in the storage capacitor Cs, a control signal ⑧ is enabled before the scan common pulse $P_{SC}$ is generated, which turns on a MOS device M2 of the scan common energy recovering unit 14. As a result, the energy stored in the storage capacitor Cs is outputted to the output node of the scan common pulse generator 12 through a diode D2, the MOS device M2 and the coil, and recycled when the scan common pulse generator 12 is operated. That is, the output node of the scan common pulse generator 12 is driven to a voltage level stored in the storage capacitor Cs of the scan common energy recovery unit 14, which reduces the power consumption by the scan common pulse generator 12.

As described above, the related art display driving circuit and energy recovery circuit and methods thereof have various disadvantages. The related art PDP driving circuit can only recover the energy only during the sustain period. An energy recovering and recycling method in other address periods has not been suggested. Accordingly, energy efficiency is low.

A power saving circuit for reducing power required to drive columns of a liquid crystal display (LCD) has been disclosed in the U.S. Pat. No. 5,528,256 (See for example FIG. 4 of U.S. Pat. No. 5,528,256). The conventional power saving circuit for the LCD panel shorts each column line to a storage capacitor through a multiplexer, and stores a voltage of each column in the storage capacitor. Thereafter, electric charges stored before a row drive period are re-applied to one column line, and thus a voltage of the column line has an intermediate value (0V). The intermediate value is driven to a high level (6V) or low level (−6V) in a next row drive period.

Accordingly, the conventional power saving circuit does not full-swing the voltage of the column from +6V to −6V, but charges the voltage from 0V to −6V and from 0V to +6V. Thus, a driving power of each column for the corresponding row drive period in a predetermined display cycle is reduced. The active matrix LCD display U.S. Pat. No. 5,528,256 (i.e. FIGS. 1–2) including column and row driver circuitry is shown in FIGS. 10–11.

As described above, however, the conventional power saving circuit for the LCD has various disadvantages. In the conventional LCD power saving circuit, when one column line has a voltage value below an average, a voltage of another column line is not stored in the storage capacitor, but moves to the column line having the voltage value below the average, which deteriorates energy recovery efficiency. In addition, the conventional power saving circuit includes the multiplexers for each column line, which is disadvantageous for integration.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Another object of the present invention is to provide a reduced power display, circuit for driving the same, and methods for operating a display and a driving circuit that substantially obviates one or more problems caused by disadvantages of the related art.

Another object of the present invention is to provide a power saving circuit of a display panel and method for operating same that increases integration.

Another object of the present invention is to provide a power saving circuit of a display panel and method for operating same that increases energy efficiency.

Another object of the present invention is to provide a power saving circuit of a display panel and method for operating same that selectively recovers energy during display of data.

Another object of the present invention is to provide a power saving circuit of a display panel and method for operating same that can be adapted to a low power display power.

Another object of the present invention is to provide a power saving circuit for a display panel that can be advantageous for integration and appropriate for embodiment in a low power display panel.

Another object of the present invention to provide a power saving circuit for a display panel that can improve energy efficiency by selectively recovering energy and performing a selective driving by an effective data.

To achieve at least the above-described objects in a whole or in part and in accordance with the present invention, there is provided a power saving circuit for a display panel that includes a display panel, a power switch that switches a power supply voltage, a drive IC that drives the display panel, and an energy recovering unit connected to the power switch and the drive IC to recover electric charges charged in a panel capacitor of the display panel through a first path of the drive IC and to provide the electric charges to the display panel through a second path of the drive IC when re-driving the display panel.

To further achieve the above objects in a whole or in part, there is provided a power saving circuit for a display panel in accordance with the present invention that includes a display panel, a power switch that switches a power supply voltage, a drive IC that drives the display panel, and an energy recovering unit connected to the power switch and the drive IC that recovers electric charges charged in a panel capacitor of the display panel through a first path of the drive IC and transmits the recovered electric charges to the display panel through a second path of the drive IC when re-driving the display panel, wherein the energy recovering unit includes a first diode having a cathode connected at a first node between the power switch and the drive IC, a first transistor having a second electrode connected to an anode of the first diode, a storage device connected between a first electrode of the first transistor and a prescribed reference voltage, a second diode having its cathode connected to the first electrode of the first transistor, and a second transistor having a second electrode connected to an anode of the second diode and a first electrode connected to the first node between the power switch and the drive IC.

To further achieve the above objects in a whole or in part, there is provided a method of operating a display panel in accordance with the present invention that includes driving a display panel with a first power supply voltage through a drive IC, recovering electric charges charged in a panel capacitor of the display panel through a first path of the drive IC in a energy recovery circuit, transmitting the recovered electric charges to the display panel through a second path of the drive IC, re-driving the display panel with the first power supply through the first path of the drive IC, and repeating the recovering through re-driving steps.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

A display panel, a power saving circuit for a display panel and methods of operating same in accordance with preferred embodiments of the present invention directly recover and use an energy from a scan electrode and a data electrode for a plasma display panel (PDP) and from a column line and a row line for a liquid crystal display (LCD) panel. That is, for the PDP, the preferred embodiments directly recover energy charged in a panel capacitor preferably through one path of a drive IC for driving a scan electrode or a data electrode. For the LCD panel, the preferred embodiments directly recover energy charged in a panel capacitor through one path of a column drive IC or row drive IC. For the LCD, a recovery path is preferably a drive IC parasitic diode or protective diode.

Figure 7:
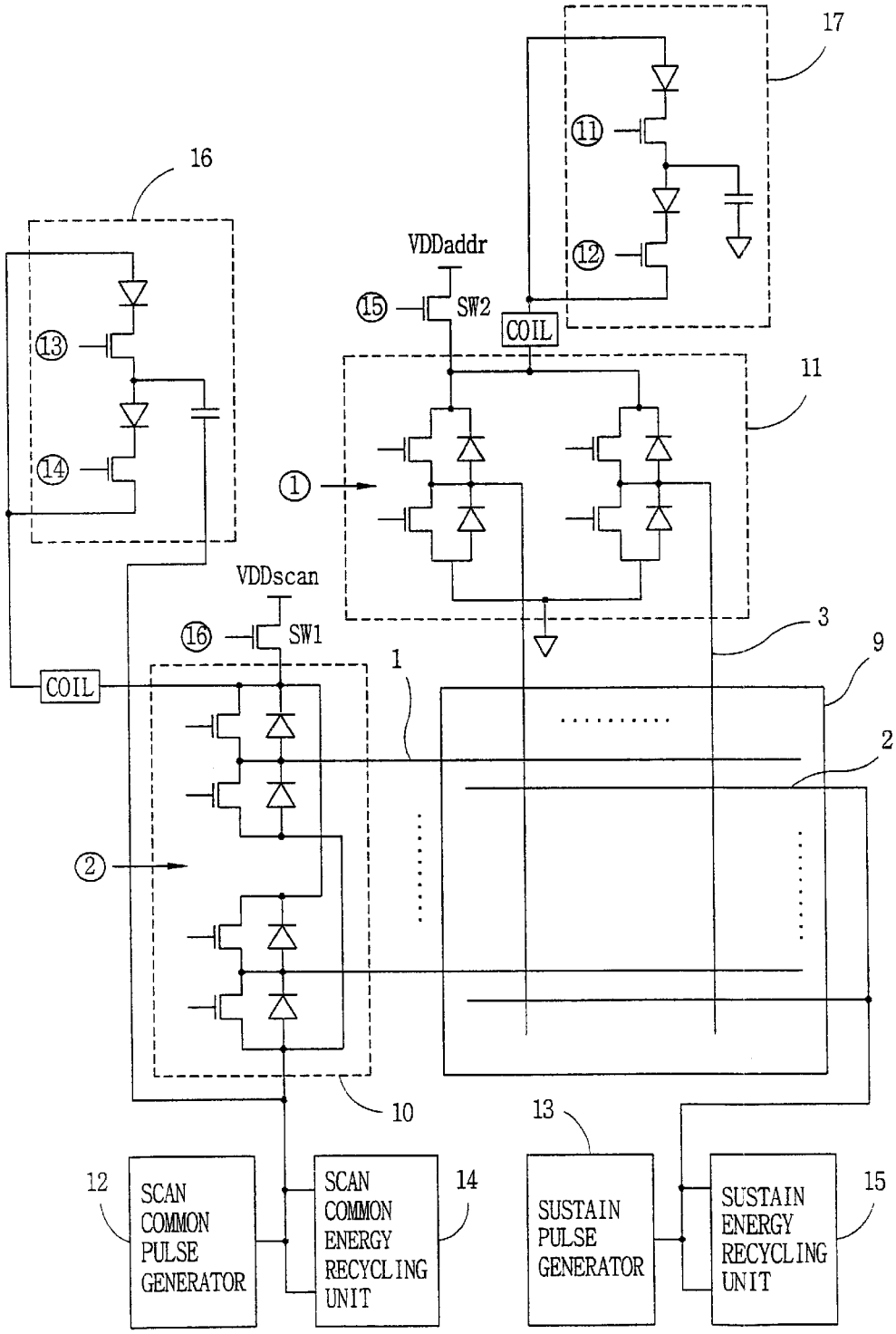
FIG. 7 is a diagram that shows a structural view illustrating a power saving circuit for a plasma display panel in accordance with a preferred embodiment of the present invention.

FIG. 7 is a diagram that shows a structural view illustrating a power saving circuit for the plasma display panel in accordance with a preferred embodiment of the present invention. In addition to components of a related art PDP driving circuit shown in FIG. 3, the preferred embodiment of the power saving circuit shown in FIG. 7 includes first and second energy recovering units 16, 17 and first and second power switches SW1, SW2.

Figure 1:
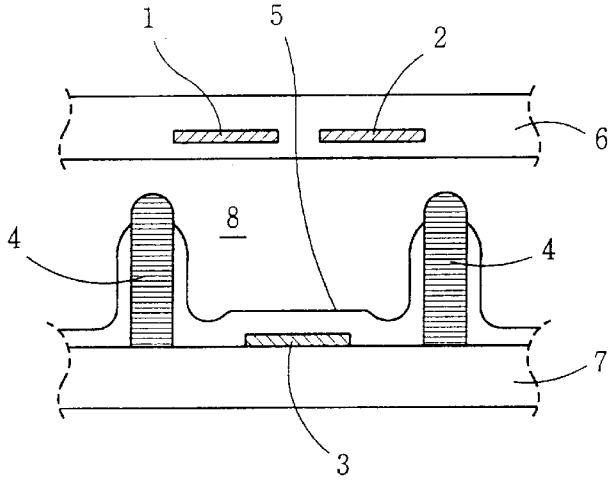
FIG.1 BACKGROUND ART
FIG. 1 is a diagram that shows a cross-sectional view illustrating a pixel structure of a related art plasma display panel.
Figure 2:
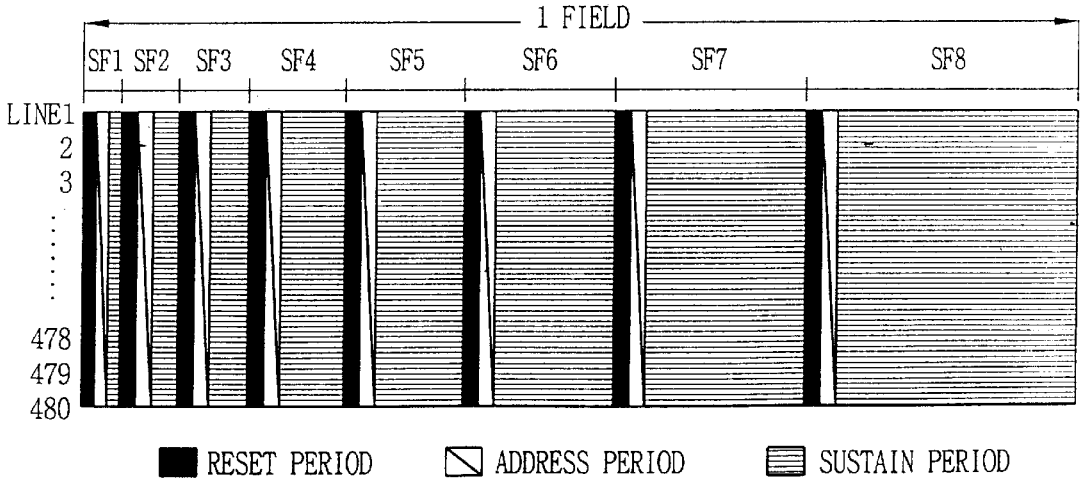
FIG.2 BACKGROUND ART
FIG. 2 is a diagram that illustrates a method for driving the related art plasma display panel.
Figure 3:
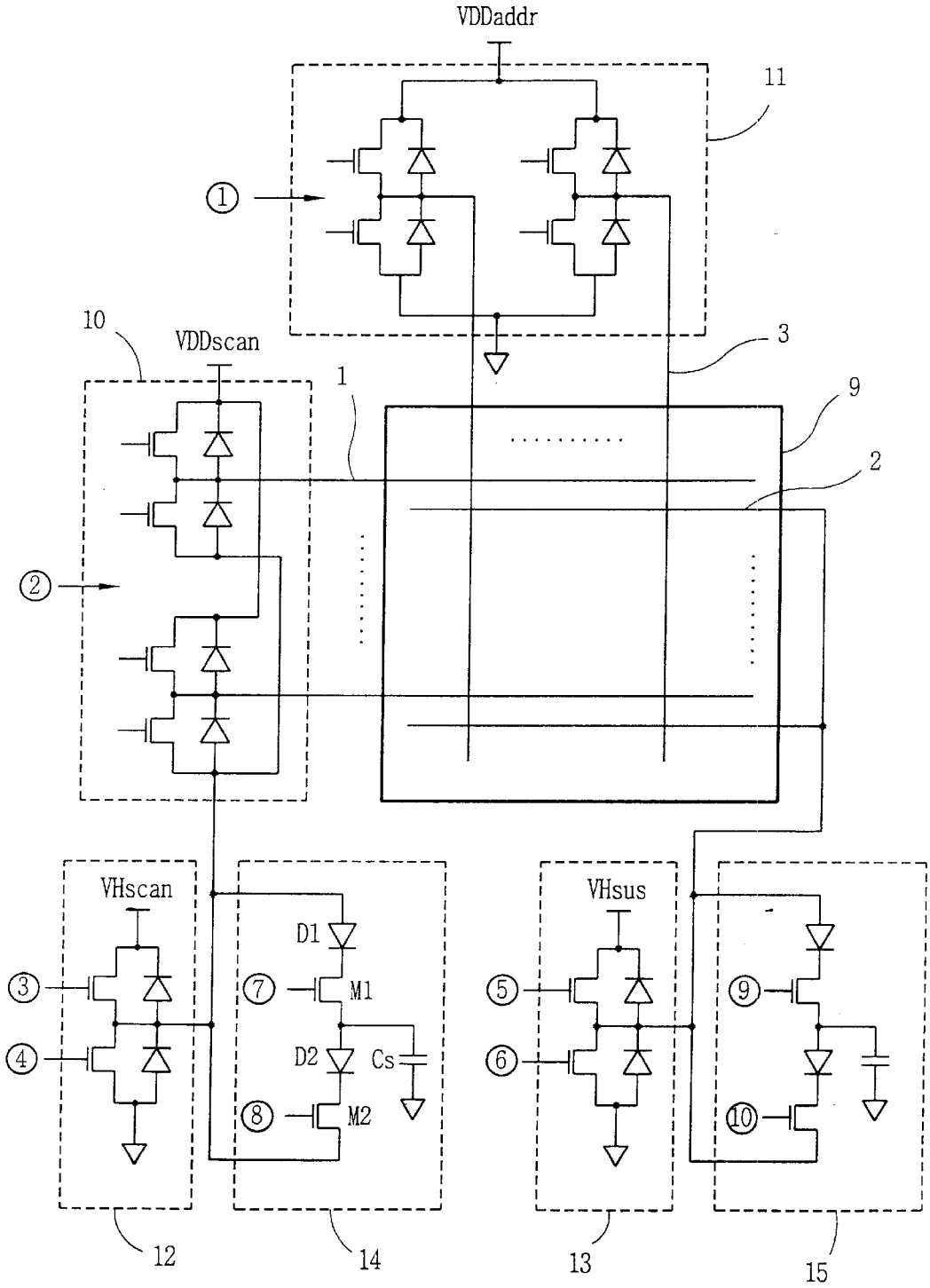
FIG.3 BACKGROUND ART
FIG. 3 is a diagram that shows a structural view illustrating the related art plasma display panel.
Figure 4:
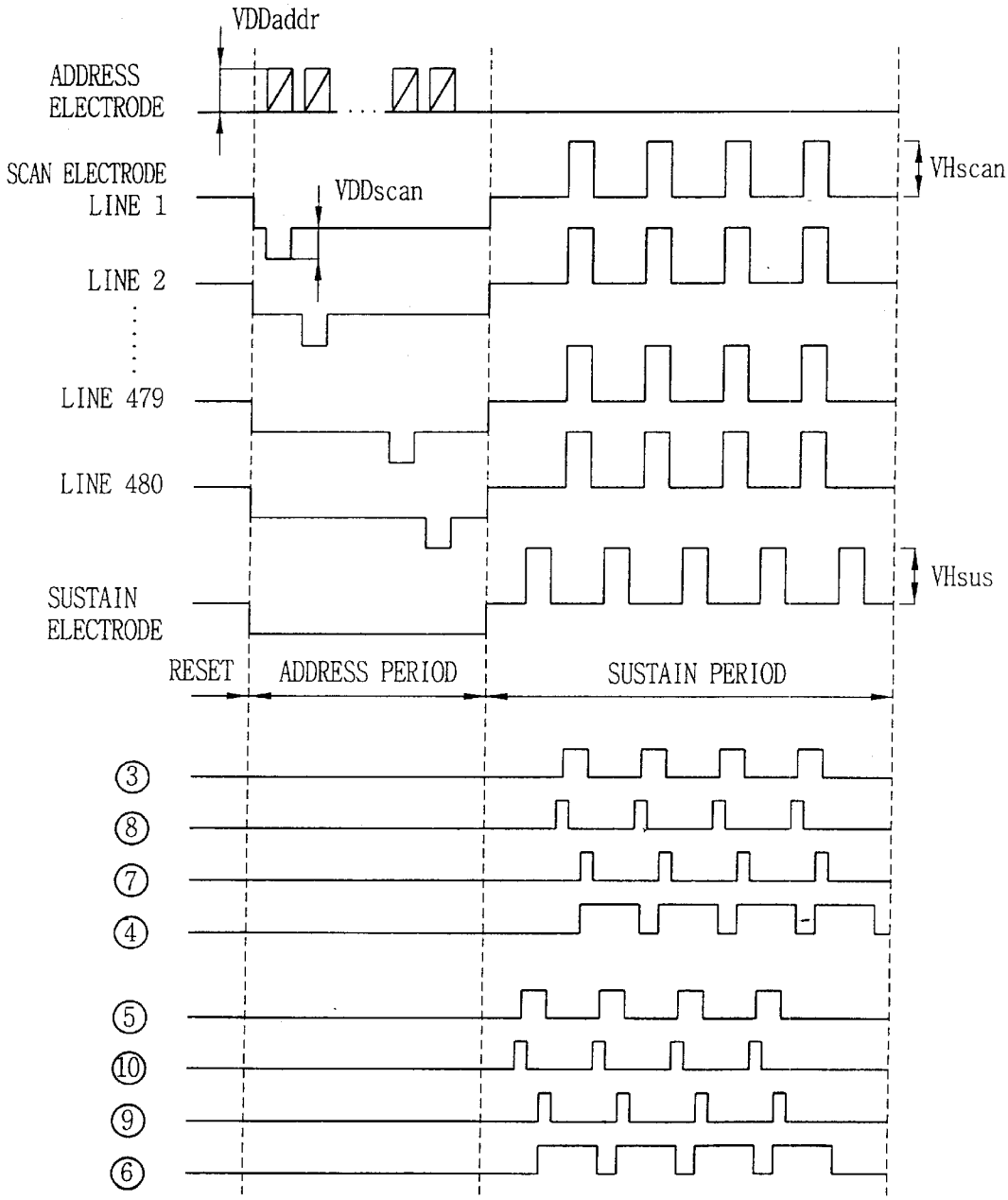
FIG.4 BACKGROUND ART
FIG. 4 is a diagram that shows waveforms of pulse signals applied during a reset period, an address period and a sustain period in FIG. 3.
Figure 5A:
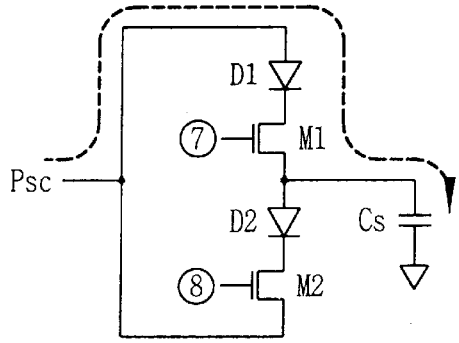
FIG.5A BACKGROUND ART
FIGS. 5A and 5B are diagrams that respectively illustrate energy recovering and recycling paths in FIG. 3.
Figure 5B:
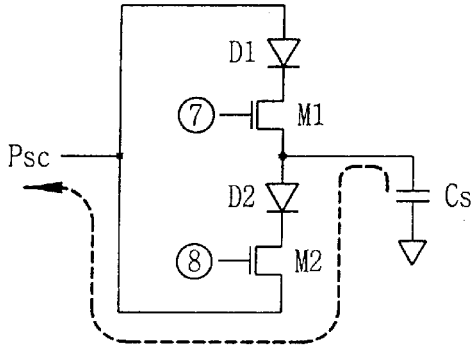
FIG.5B BACKGROUND ART
Figure 6:
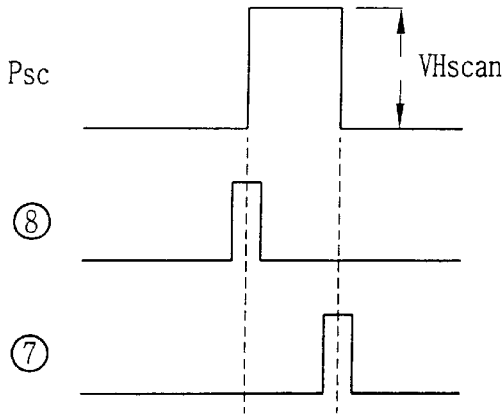
FIG.6 BACKGROUND ART
FIG. 6 is a diagram that shows waveforms of control signals for controlling energy recovering and recycling operations in FIG. 5.

The first and second energy recovering units 16, 17 are circuits or blocks for directly recovering the energy from the scan electrode 1 and the data electrode 3, respectively. The first energy recovering unit 16 is coupled between the first power switch SW1 and a scan drive IC 10, and the second energy recovering unit 17 is coupled between the second power switch SW2 and a data drive IC 11. In addition, the first and second energy recovering units 16, 17 are similar in constitution to the related art scan common energy recovering unit 14 and sustain energy recovering unit 15 shown in FIG. 3. Although in the first energy recovering unit 16, one side electrode of a storage capacitor Cs is coupled to an output node of a scan common pulse generator 12 because a ground voltage of the scan drive IC 10 is supplied from a voltage waveform outputted from the scan common pulse generator 12. However, the preferred embodiments of the present invention are not limited by the above description. For example, one side of the capacitor Cs in the first energy recovery unit 16 may be coupled directly to the ground voltage. As shown in FIGS. 3 and 7, the identical elements to the related art are provided with the same reference numerals.

Operations of the power saving circuit for the display panel in accordance with the preferred embodiment of the present invention shown in FIG. 7 will now be described. The preferred embodiment of the present invention directly recovers and uses the energy from the panel capacitor (not shown) of the scan electrode 1 and the data electrode 3 of the PDP. That is, the preferred embodiment preferably directly recovers the energy through one path (e.g., recovery path) of the drive IC driving the scan electrode 1 or data electrode 3, and the recovery path is preferably the parasitic diode or protective diode of the scan drive IC 10 and the data drive IC 11.

Energy recovering and recycling operations will now be described in regard to the second energy recovering unit 17. Energy recovery and recycling operations of the first energy recovery unit 16 are similar to the second energy recovery unit 17. The operations of the scan common pulse generator 12, the sustain pulse generator 13, the scan common energy recovering unit 14 and the sustain energy recovering unit 15 are identical to the related art, and thus a detailed description is omitted here.

Figure 8A:
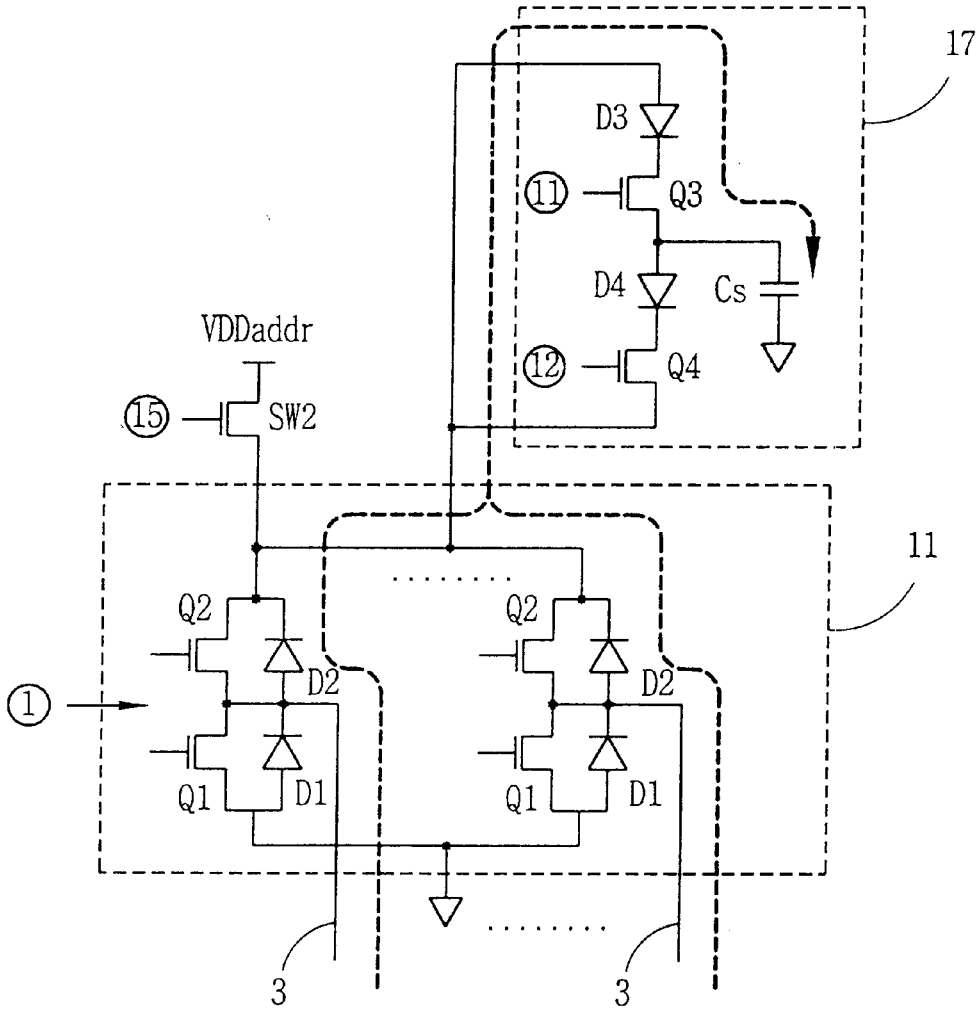
FIGS. 8A and 8B are diagrams that respectively illustrate energy recovering and recycling paths in FIG. 7.
Figure 8B:
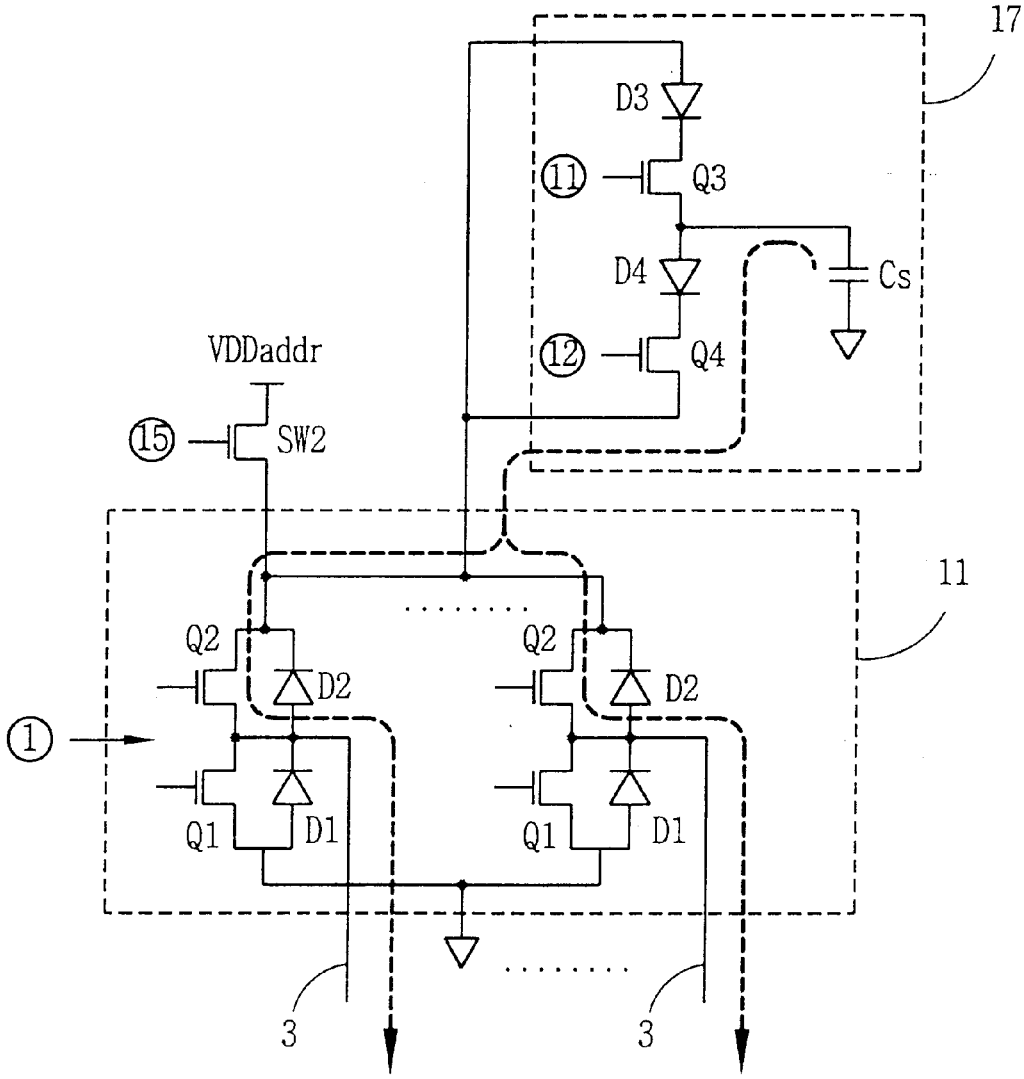

FIG. 8A is a diagram that illustrates the energy recovery path for recovering the energy from the panel capacitor (not shown) of the data electrode 3. As shown in FIG. 8A, the energy charged in the panel capacitor of the data electrode 3 during an address period of one sub-frame is stored in the storage capacitor Cs of the second energy recovering unit 17 through the protective diode D2 formed in each output pin of the data drive IC 11. Thereafter, as illustrated in FIG. 8B, the energy that is previously stored in the storage capacitor Cs of the second energy recovering unit 17 is provided to the data electrode 3 during the address period of a next sub-frame through an output driving transistor Q2 of the data drive IC 11.

FIGS. 9A–9D are diagrams that show preferred waveforms of control signals for energy recovering and recycling operation methods. The energy recovering and recycling operations will now be described with reference to FIGS. 8A–9D.

(1) Energy Recovering Operation

Figures 9A, 9B, 9C, 9D:
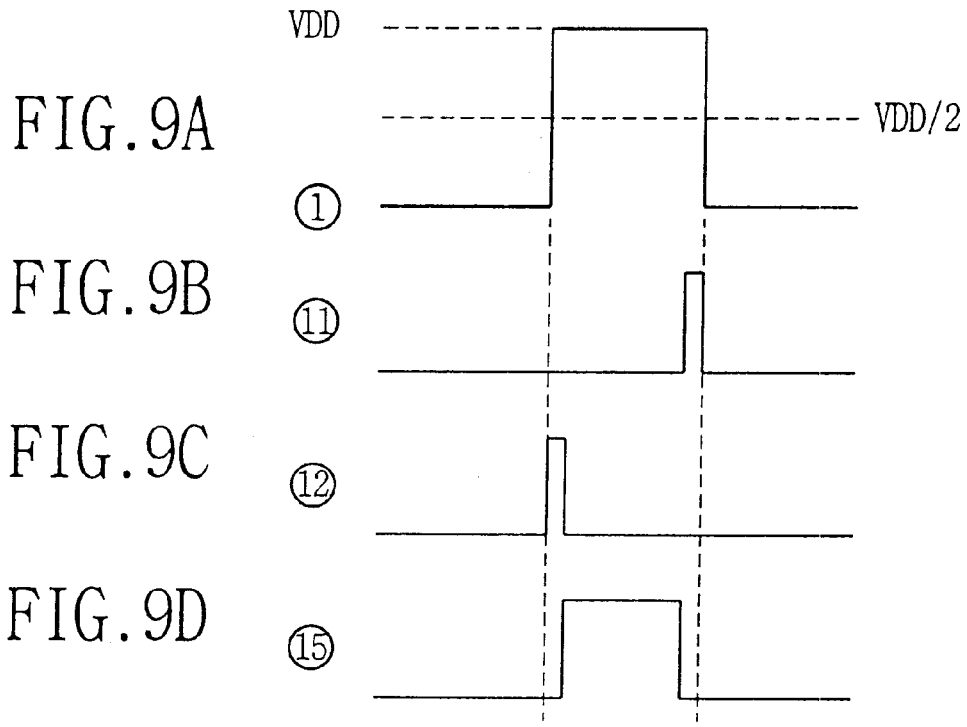
FIGS. 9A to 9D are diagrams that show waveforms of control signals for controlling energy recovering and recycling operations in FIG. 8.
Figure 10:
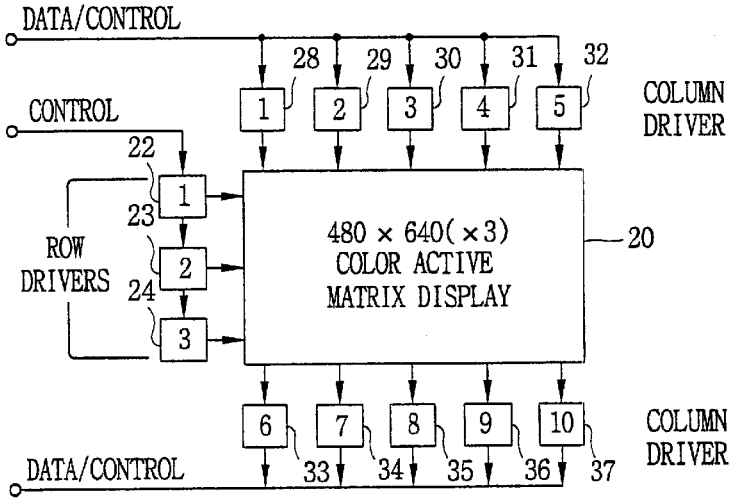
FIGS. 10 to 11 are diagrams that show an active matrix LCD display including column and row driver circuitry.
Figure 11:
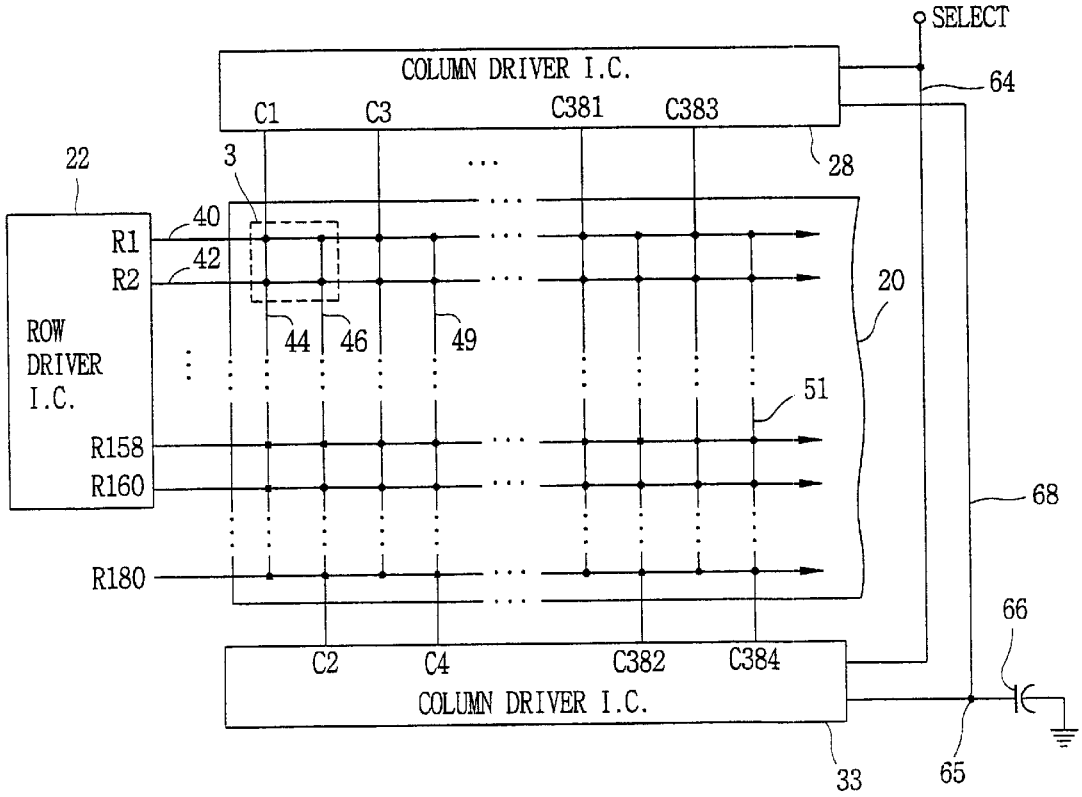

When one scan electrode line is selected by the scan drive IC 10 during the address period, the data drive IC 11 applies a data pulse of VDD level to the address electrode 3 according to a pixel data ① provided by a memory (not shown), which operates to write the pixel data on pixels existing on the selected line. That is, as depicted in FIG. 8A, during the address period, the second power switch SW2 and the output driving transistors Q1, Q2 are turned on according to control signals ⑮, ① as shown in FIGS. 9D and 9A, respectively, and the data pulse of the VDD level having an identical pulse width to the control signal ⑮ is applied to the data electrode 3.

In this state, the energy is preferably recovered by enabling a control signal ⑪ for a predetermined time until the control signal ① is disabled. According to the preferred embodiment of the present invention, a time from a disable time of the control signal ⑮ to a disable time of the control signal ① is preferably set to be a pulse width of the control signal ⑪. Accordingly, a transistor Q3 of the second energy recovering unit 17 is turned on by the control signal ⑪, and thus, the energy charged in the panel capacitor of the data electrode 3 is preferably stored in the storage capacitor Cs of the second energy recovering unit 17 through the protective diode D2, the coil, the diode D3 and the transistor Q3. As shown in FIG. 9D, the stored energy is at least VDD/2. However, the preferred embodiments are not limited by the foregoing description. For example, the energy of the data electrode 3 may be recovered in a state where the output driving transistors Q1, Q2 are all turned off.

In addition, when an output channel value of the drive IC is at a low level, the reverse direction is applied to the protective diode D2 so that the energy recovering operation may not be performed. As a result, according to the preferred embodiment, the energy may be selectively recovered from the data electrode 3 where the effective data is written.

(2) Energy Recycling Operation

The energy (electric charges) stored in the storage capacitor Cs of the second energy recovering unit 17 are recycled during a next cycle, namely the address period of a next sub-frame. That is, as illustrated in FIG. 9C, a control signal ⑫ is preferably enabled before the control signal ⑮ is enabled, and the output driving transistors Q1, Q2 are turned on according to the pixel data ① as shown in FIG. 9A. As a result, a transistor Q4 is turned on according to the control signal ⑫, and thus, the energy (electric charges) stored in the storage capacitor Cs of the second energy recovering unit 17 is provided to the data electrode 3 through the diode D4, the transistor Q4, the coil and the output driving transistor Q2.

Once the data electrode 3 is initially driven by the energy (electric charges) stored in the storage capacitor Cs, the control signal ⑮ as shown in FIG. 9D is enabled, which turns on the second power switch SW2. As a result, an external supply voltage VDDaddr is provided to the data electrode 3 through the second power switch SW2 and the output driving transistor Q2. Thus, the data electrode 3 is driven by a datapulse $P_D$ of the VDD level.

As described above, according to the preferred embodiment of the present invention as shown in FIG. 7, the data electrode 3 is driven by the energy (VDD/2 level) stored in the storage capacitor Cs of the second energy recovering unit 17, and driven by the external supply voltage VDDaddr, to reduce the supply voltage VDDaddr required to drive the data electrode 3 during the address period preferably by half. In addition, the preferred embodiment selectively drives the data electrode 3 by the effective pixel data after recovering the energy of the data electrode 3.

The energy recovering and recycling operations of the preferred embodiment are described above in regard to the second energy recovering unit 17. However, the operation of the first energy recovering unit 16 is identical to that of the second energy recovering unit 17, and thus, an identical effect can preferably be obtained.

In addition, according to preferred embodiments of the present invention, the power saving circuit is applied to the PDP as shown in FIG. 7. However, the present invention is not intended to be so limited. For example, preferred embodiments of the present invention can be applied to the LCD panel as described above.

As described above, preferred embodiments of power saving circuits for a display panel and methods of operating the same have various advantages. Since the preferred embodiments drive the display panel by using the energy stored in a storage capacitor or device during a previous cycle, and then drive the display panel using the external supply voltage, the power consumption is reduced when driving an LCD panel and a PDP. Further, the preferred embodiments according to the present invention recover the unnecessary energy from the display panel, which decreases a cross torque and a mis-discharge between the adjacent electrodes in the PDP. The preferred embodiments can operate during an addressing period.

Additional advantages include the preferred embodiments can selectively recover the energy. The conventional power saving circuit for the LCD stores the driving voltage in the external storage capacitor by shorting the whole output channels of the panel. However, in accordance with preferred embodiments of the present invention when the output channel value of the drive IC is at a low level, for example the reverse direction is applied to the protective diode, and thus the energy recovering operation does not occur. In addition, the conventional power saving circuit performs driving, recovering, shorting (i.e., apply an intermediate value) and driving steps and therefore includes an unnecessary driving step. However, the preferred embodiments can perform the selective driving by the effective data after recovering the energy of the data electrode according to the driving, recovering and driving steps, which results in improved energy efficiency. The present invention does not include a multiplexer in an output terminal, unlike the conventional power saving circuit for the LCD, which increases integration and easily allows the implementation thereof.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A power saving circuit for a display panel, comprising:

a display panel;

a power switch that switches a first prescribed voltage level;

a scan drive IC that drives the display panel;

a scan common pulse generator coupled to the scan drive circuit;

a scan common energy recovery circuit coupled to the scan common pulse generator;

a sustain pulse generator coupled to the display panel; and a sustain energy recovery circuit coupled to the sustain pulse generator; and an energy recovering circuit connected to the power switch and the scan drive IC that recovers electric charges charged in a panel capacitor of the display panel through a first path of the scan drive IC and transmits the recovered electric charges to the display panel through a second path of the scan drive IC when re-driving the display panel, wherein the energy recovering circuit operates in an addressing period of the display panel, and wherein the energy recovering circuit comprises, a first diode having a cathode connected at a first node between the power switch and the drive IC, a first transistor having a second electrode connected to an anode of the first diode, a storage capacitor connected between a first electrode of the first transistor and a second prescribed voltage level, a second diode having its cathode connected to the first electrode of the first transistor, and a second transistor having a second electrode connected to an anode of the second diode and a first electrode connected to the first node between the power switch and the drive IC, wherein the energy recovering circuit does not recover the electric charges charged in the panel capacitor when an output channel value of the drive IC is at a low level.

2. The circuit according to daim 1, wherein the power switch is a MOS transistor.

3. The circuit according to claim 1, wherein the display panel is driven by a first voltage provided by the energy recovering unit before the power switch is turned on, and driven by the first prescribed voltage level provided by the power switch when the power switch is turned on.

4. The circuit according to claim 3, wherein the first prescribed voltage level is a power supply voltage, and wherein the first voltage is at least a half of the power supply voltage.

5. The circuit according to claim 1, wherein the first path of the drive IC is one of a parasitic diode and protective diode.

6. The circuit according to claim 1, wherein the second path is an output driving transistor of the drive IC.

7. The circuit as according to claim 1, wherein a voltage stored in the storage capacitor is at least a half of the power supply voltage.

8. A power saving circuit for a display panel, comprising:

a display panel;

a power switch that switches a power supply voltage;

a scan drive IC that drives the display panel; and an energy recovering unit connected to the power switch and the scan drive IC that recovers electric charges charged in a panel capacitor of the display panel through a first path of the scan drive IC and transmits the recovered electric charges to the display panel through a second path of the scan drive IC when re-driving the display panel;

a data drive circuit coupled to the display panel;

a scan common pulse generator coupled to the scan drive IC;

a scan common energy recovery circuit coupled to the scan common pulse generator;

a sustain pulse generator coupled to the display panel; and a sustain energy recovery circuit coupled to the sustain pulse generator, wherein the energy recovering unit comprises, a first diode having a cathode connected at a first node between the power switch and the scan drive IC, a first transistor having a second electrode connected to an anode of the first diode, a storage device connected between a first electrode of the first transistor and a prescribed reference voltage, a second diode having its cathode connected to the first electrode of the first transistor, and a second transistor having a second electrode connected to an anode of the second diode and a first electrode connected to the first node between the power switch and the scan drive IC, wherein the energy recovering circuit operates in an addressing period of the display panel, wherein the voltage stored in the storage capacitor is at least a half of the power supply voltage, and wherein the energy recovering unit does not recover the energy when an output channel value of the drive IC is at a low level and a data drive energy recovery circuit coupled to the data drive circuit.

9. The circuit according to claim 8, wherein the display panel is driven by a voltage provided by the energy recovering unit before the power switch is turned on, and driven by the power supply voltage provided by the power switch when the power switch is turned on.

10. The circuit according to claim 8, wherein the first path includes one of a parasitic diode and protective diode of the drive IC.

11. The circuit according to claim 8, wherein the second path includes an output driving transistor of the drive IC.

* * * * *